United States Patent [19]

Gugel

[11] 3,981,504

[45] Sept. 21, 1976

[54] GLASS-CARBON REINFORCED FOAMED RESIN TENNIS RACKET FRAME

[75] Inventor: John D. Gugel, Columbus, Ind.

[73] Assignee: PPG Industries, Inc., Pittsburgh, Pa.

[22] Filed: Nov. 25, 1974

[21] Appl. No.: 526,648

Related U.S. Application Data

[63] Continuation-in-part of Ser. No. 452,302, March 18, 1974, abandoned.

[52] U.S. Cl. ..... 273/73 F; 273/DIG. 1; 273/DIG. 2; 273/DIG. 6; 273/DIG. 7; 273/DIG. 23

[51] Int. Cl.[2] ..... A63B 49/10

[58] Field of Search ..... 273/67 R, 67 A, 72 R, 273/73 R, 73 C, 73 D, 73 F, 73 H, 82 R, DIG. 1–DIG. 12; 156/180, 441; 280/11, 13 L; 427/212; 264/109

[56] References Cited

UNITED STATES PATENTS

| | | | |
|---|---|---|---|
| 3,306,960 | 2/1967 | Weissman et al. | 273/82 R X |
| 3,478,134 | 11/1969 | Gruss et al. | 273/82 R X |
| 3,491,055 | 1/1970 | Talley | 273/DIG. 23 |
| 3,598,693 | 8/1971 | Andersen et al. | 273/82 R X |
| 3,644,168 | 2/1972 | Bonk et al. | 273/73 F X |
| 3,647,211 | 3/1972 | Doessel et al. | 273/73 C |
| 3,690,658 | 9/1972 | Howe | 273/73 C |
| 3,691,000 | 9/1972 | Kalnin | 273/DIG. 23 |
| 3,770,033 | 11/1973 | Gavillet et al. | 273/73 F X |
| 3,787,051 | 1/1974 | Johns | 273/73 F |

FOREIGN PATENTS OR APPLICATIONS

| | | | |
|---|---|---|---|
| 210,557 | 3/1956 | Australia | 273/DIG. 7 |

*Primary Examiner*—Richard J. Apley
*Attorney, Agent, or Firm*—John E. Curley

[57] ABSTRACT

A molded, plastic tennis racket frame is described which is constructed of a combination of glass fiber reinforcement and carbon fiber reinforcement to provide a low specific gravity composite when incorporated in resins which are reinforced by these materials and to permit construction of a tennis racket having a general shape of conventional wooden rackets. The tennis racket is constructed as a unitary piece utilizing foamed resins reinforced with the glass fibers and carbon fibers. Specific weight percentages of glass fibers and carbon fibers are designated for maximum strength, flexibility and good playing characteristics.

6 Claims, 6 Drawing Figures

GLASS-CARBON REINFORCED FOAMED RESIN TENNIS RACKET FRAME

CROSS-REFERENCE TO RELATED APPLICATIONS

This application is a continuation-in-part of application Ser. No. 452,302, filed Mar. 18, 1974, now abandoned.

BACKGROUND OF THE INVENTION

Tennis racket frames have been constructed of various structural materials such as wood, metal and plastic in the past. Typically, tennis rackets of the prior art had a generally oval shape and have been constructed of wood, usually having the appearance of a unitary piece but made up of several laminations of various types of wood to provide the proper weight and good playing characteristics. In recent years steel and aluminum have also been used as basic structural materials for manufacturing tennis racket frames. Due to the increased density of metal over conventional wood racket designs, the rackets made of metal have changed to a less oval configuration that conventional wooden rackets and the width of the frame material has been reduced. Typical of the tennis racket frames produced out of metallic materials is the tennis racket frame shown in U.S. Pat. No. 3,605,252. A more recent U.S. Pat. No. 3,647,211 shows a molded plastic tennis racket in which the frame material is composed of a solid polycarbonate resin. In order to compensate in part for the weight imposed on the frame by use of the polycarbonate, the handle and throat portions of the frame shown are provided with a plurality of apertures.

While all of the tennis racket frames of the prior art have exhibited adequate utility, changes over conventionally shaped wooden rackets have been necessitated to compensate for increased racket weight when metal is employed as the frame material. In the case of plastic resinous materials, the racket is often designed with a multiplicity of apertures in portions of the handle and/or frame to compensate for the high density of the resins employed to manufacture the frame. Wooden rackets of course have been conventionally employed for years and are subject to damage caused by vigorous play in the form of cracks and chips in the frame portions of the racket and warpage due to moisture.

THE PRESENT INVENTION

In accordance with the instant invention, a molded, plastic tennis racket frame is provided which avoids many of the problems created by prior art constructions. Thus, a molded, glass fiber — carbon fiber reinforced tennis racket frame is provided wherein the resin density can be controlled to permit the racket to be constructed in the shape of conventional wooden rackets. The frame is characteristically constructed of a foamed resin core surrounded by a dense, skinlike layer which provides a tough outer shell for the foamed core. Both the core and shell of the frame are reinforced with both glass fibers and carbon fibers to provide overall, a racket frame of excellent strength. The carbon fibers provide stiffness to the racket, help keep the overall weight of the racket at acceptable levels and contribute considerably to the overall flexural strength of the finished article. The fiber glass reinforcement contributes to the flexural strength of the finished article and imparts stiffness to the finished frame without imparting any substantial brittleness to it. In general, the core portion of the racket contains a plurality of voids created by escaping gases during the foaming of the resin during manufacture. In the preferred embodiments of the instant invention, the core of the racket occupies 75 percent or more of the total volume of the frame. The resin frame of the instant invention in completed form typically has a specific gravity below 1 and preferably about 0.85 or less.

In constructing the tennis racket frames of the instant invention, injection molding techniques utilized to manufacture structural foam resins may be employed. A summary of the many of the processes which are commonly used in producing injection molded thermoplastic resin products is described in *Modern Plastics Encyclopedia*, Vol. 49, No. 10*a*, 1972 – 1973, McGraw-Hill Publishing Co., pgs. 283 – 292. The molded, glass fiber - carbon fiber reinforced, tennis racket frame of the instant invention may employ various resins or plastics. Thus, polycarbonates, nylon, polystyrenes and other similar materials and mixtures thereof may be employed. In the preferred embodiment of the instant invention, nylon is preferred as the resin material. Nylon resins it has been found, reinforced with glass fibers in carefully controlled quantities, i.e. 7 to 20 percent by weight and also employing as reinforcement between 7 to 20 percent by weight carbon fibers, produce tennis racket frames of substantial durability and strength. In a preferred embodiment of the invention a nylon resin reinforced with 15 to 18 percent glass fibers and 7 to 10 percent carbon fiber is employed. Thus, utilizing the combination of glass fibers and carbon fibers in connection with convention foam molding of plastic materials such as nylon, polycarbonates, polystyrenes and the like results in a finished tennis racket frame having adequate density characteristics. In addition structural strength is imparted to tennis racket frames considerably in excess of the strengths which can be obtained utilizing glass fibers as the sole reinforcing agent.

Carbon fibers inherently possess very high Young's modulus characteristics; for example, 30,000,000 psi (2,109,000 Kilograms per square centimeter) is not unusual for these materials. This property, while excellent for certain resin reinforcing applications, imparts a stiffness to molded resin articles of such magnitude that such reinforced resins would be unacceptable for use in tennis racket frames which require not only strength but also flexibility. By combining carbon fibers with glass fibers in reinforcing molded resin tennis racket frames in the quantities described herein, tennis frames having adequate durability and good playing characteristics are readily realized.

In addition, by combining glass fibers and carbon fibers in the precise formulations herein described, a foamed reinforced resin is produced which possesses specific gravity properties rendering it suitable for use as tennis racket frame material. The overall weight of tennis frames constructed in accordance with this invention is such that rackets of conventional design, i.e. shapes conforming to conventional wooden rackets, may be readily employed in the finished product. Thus, nylon and polycarbonate structural foam molded racket frames reinforced by the carbon - glass system described herein need not be shaped in the same fashion as those constructed of heavier materials such as metal.

The resin materials utilized to manufacture the tennis racket frames of the instant invention may be mixed with the glass and carbon fibers in the manufacturing of the article as part of the manufacturing process. The glass and carbon fibers may also be coated with the resin to be employed prior to manufacturing and the resin coated fibers utilized as the feed to the manufacturing process with or without the use of additional resin depending on the extent to which the fibers are coated. In the preferred method of manufacturing, pellets of resin having the glass fibers present therein and pellets of resin having the carbon fibers present therein are mixed and fed to the molding process in the desired proportions.

In molding the racket frames of the instant invention the glass - carbon resin feed is conventionally mixed with a foaming agent, heated to the desired molding temperature and injected into the mold at high injection pressures. Various foaming agents may be employed with the resin to provide the structural foam characteristics desired for the molded resin product. A comprehensive disclosure of a plurality of conventional foaming agents and their properties is contained in *Modern Plastics Encyclopedia*, hereinabove referred to, on pages 292 and 294 thereof. The racket frame of the instant invention may be molded in conventional high pressure molding machines using a mold conforming to the contour of the finished frame. A discussion of typical molding equipment that can be utilized to prepare the frame of the instant invention is contained in *Polymers and Resins, Their Chemistry and Chemical Engineering*, Brage Golding, 1959, D. Van Austrian Company, Princeton, N.J. pgs. 590 - 592.

In molding the fibers of carbon and glass are reduced considerably in length going through the mold gate. Thus, while their lengths as supplied to the accumulator is in the range of 0.125 to 0.5 inches (3.75 to 12.7 millimeters) preferably 0.25 to 0.375 inches (6.35 to 9.525 millimeters) the fiber lengths in the molded frame is found to be in the range of 0.044 to 0.045 inches (1.118 to 1.143 millimeters). The carbon fiber diameters range between about 0.000125 to about 0.0002 inches (0.00317 to 0.00508 millimeters) preferably 0.000145 to 0.00016 inches (0.0037 to 0.00406 millimeters) and the glass fibers range between about 0.00025 to 0.00038 inches (0.00635 to 0.0096 millimeters) preferably about 0.00029 to 0.00036 inches (0.007366 to 0.0096 millimeters). In the finished article this provides an L/D ratio (L-fiber length; D-fiber diameter) of about 118 to about 176 for the glass fiber and 225 to 352 for the carbon fibers, preferably 125 to 152 for the glass fiber and 281 to 303 for the carbon. In the above ratios of length to diameter with the weight distribution of glass fibers between 7 and 20 percent and carbon fibers between 7 and 20 percent rackets of excellent playing qualities are provided.

For a more complete understanding of the instant invention, reference is made to the accompanying drawings in which.

Figure 1:
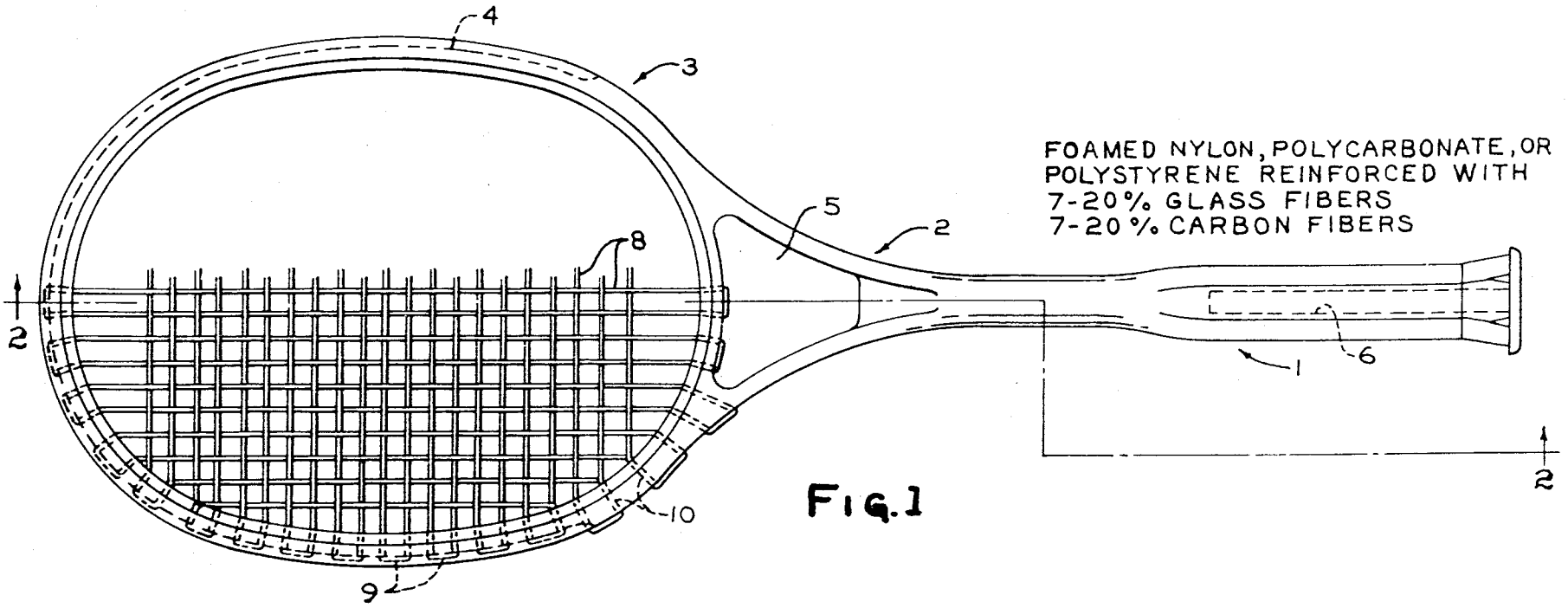
FIG. 1 is a plan view of the novel tennis racket frame with the strings in place on one side.

As seen in the drawing of FIG. 1, the tennis racket frame has a handle section 1, a throat portion 2 and a head member 3. The head member 3 is provided with a recess 4 which encompasses the head 3 over about 55 to 80 percent of the outside surface thereof. A large aperture 5 is provided in the throat portion 2 of the tennis racket frame. A drilled section 6 in the handle of the racket is provided to properly balance the finished tennis racket frame. The strings 8 are fastened through suitable holes 9 provided in recess 4 of the frame and through similar holes 10 provided in the lower portions of the head 3.

Figure 2:
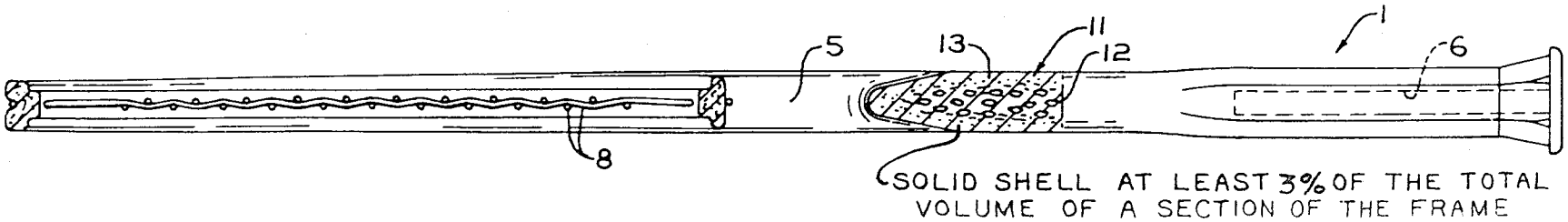
FIG. 2 is a partial cross section of the frame of FIG. 1 taken along lines 2—2 of FIG. 1.

As seen in FIG. 2, the frame of the racket is provided with a core 11 characterized by having a multiplicity of voids 12 therein from the center of the frame towards the surface thereof. Adjacent the surface is a thin layer of solid resin 13 which forms the outer shell of the frame. The thickness of this shell can be controlled to any desired depth and typically is between 3 and about 20 percent of the total volume of any cross section of the molded frame.

Figure 4:
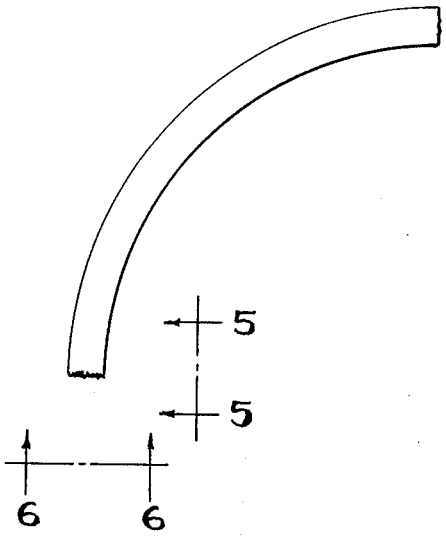
FIG. 4 is a section of the frame of FIG. 1 used to demonstrate fiber orientation at a break point.
Figure 5:
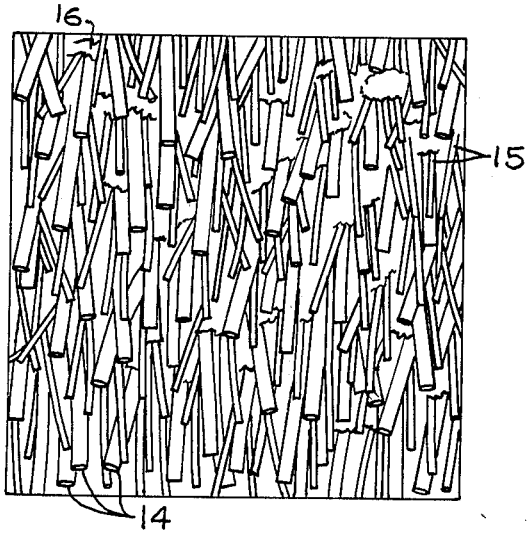
FIG. 5 is an artist's conception of a photograph at 50 times magnification taken of a section along lines 5 — 5 of FIG. 4.

FIG. 4 shows a piece of a frame constructed in accordance with the instant invention broken away from the frame. A section taken along lines 5 — 5 of that piece was photographed at a 50 times magnification and FIG. 5 is an artist's rendition of that photograph. As can be seen in that view the glass fiber 14 and the carbon fiber 15 are oriented in a longitudinal plane in a random pattern. Thus they follow the contour of the racket with their long axis paralleling the long axis of the racket.

Figure 3:
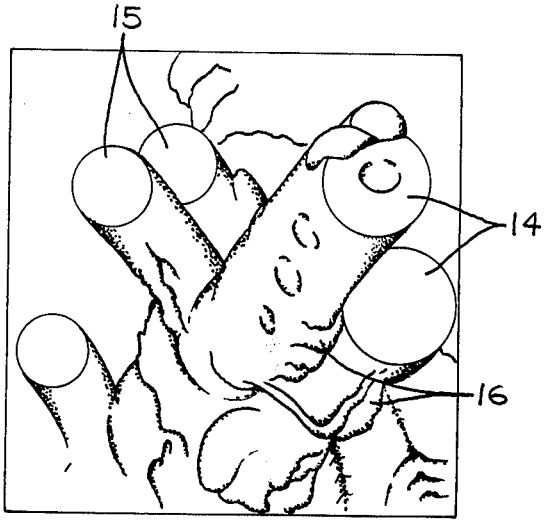
FIG. 3 is an artistic rendition of a photograph of a section of the tennis racket frame material at 1500 magnification showing the fibers and apron bonding.
Figure 6:
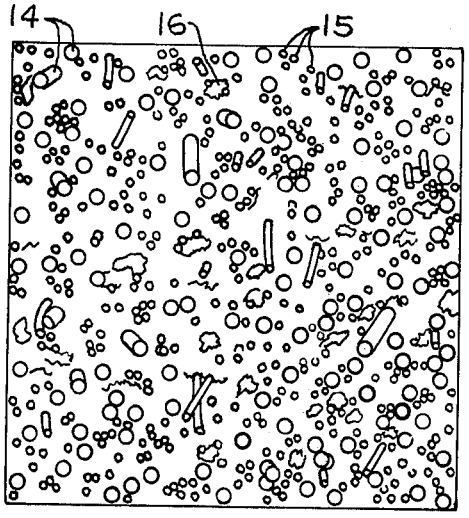
FIG. 6 is an artist's conception of a photograph at 50 times magnification taken of a section along lines 6 — 6 of FIG. 4.

FIG. 6, which is an artist's rendition of a photograph at 50 times magnification of a view of the end of the piece of FIG. 4 looking up at lines 6 — 6 shows the ends of glass fiber 14 and carbon fiber 15 as they appear at the break, again indicating their longitudinal alignment in the racket frame. The view in FIG. 3 was constructed from a photograph of a cross section of the racket frame material taken at a 15,000 times magnification to show the relative size of the glass fiber 14 to the carbon fiber 15 and the adherence of the nylon 16 to both the glass and the carbon.

The following examples are illustrative of procedures utilized to prepare the novel tennis racket frames of the instant invention.

EXAMPLE 1

A 6–12 nylon having 10 percent by weight glass fibers and 15 percent by weight carbon fibers was employed as the resin ingredient. The nylon — glass and nylon — carbon pellets ⅛ inch diameter and ¼ inch long (3.175 to 6.35 millimeters) were dried and then mixed with 0.25 weight percent of EXPANDEX OX-5 PT, a material described in U.S. Pat. No. 3,442,829 and manufactured by the National Polychemical Division of Stepan Chemical Company, Wilmington, Massachusetts. The material after mixing was fed to a hopper which was in communication with the molding machinery. The hopper was connected to a fixed screw plasticizer barrel which was temperature controlled from the feed inlet to the outlet thereof. The inlet temperature was maintained at 390°F. (198.9°C.) and the outlet temperature was maintained at 475°F. (246.11°C.).

The outlet of the fixed screw barrel was connected to an accumulator into which the plastic was introduced and maintained at a temperature of 590°F. (310°C.) and a pressure of about 150 psi (10.5 kilograms per square centimeter). A hydraulic pressure molding machine having a 135 ounce (3.826 kilogram) shot capacity was employed. The mold was a steel mold base with cavity core plates being constructed of aluminum. The mold temperature was controlled and maintained at 200°F. (93.33°C.) on both halves. Drooling at the in-point orifice to the mold was controlled by a positive shutoff nozzle. The material in the accumulator was injected into the mold at 600°F. (315.5°C.) under pressure of between 11,000 to 12,000 psi (773.3 to 843.6 kilograms per square centimers). In preparing the racket frame of this embodiment, a shot weight of 16 ounces (9.45 kilograms) was employed. The racket frame cycle time from injection to removal was about 2 minutes. The mold used was designed to provide a frame 27 inches long (685.8 millimeters) having a weight of 13 ounces (0.368 kilograms) and a balance of 13–½ inches (342.9 millimeters) from top of bow. Upon completion of the molding cycle a finished tennis racket frame was removed and strung in a conventional stringing machine.

The structural characteristics of the novel frames of the instant invention are such that the frames are capable of withstanding the rigors of competitive playing. The core and shell structure being adjustable, renders the frames readily adaptable to various playing weights. The glass and carbon fibers were found to have overall original length of 0.044 to 0.045 inches (1.12 to 1.143 millimeters) in the finished article. The diameter of the fiber was about 0.00029 inches (0.00736 millimeters) and the carbon fibers 0.000146 inches (0.00368 millimeters). This provided an L/D ratio for the glass of about 150 and for the carbon of about 303.

In general, the amount of blowing agent added may vary between 0.15 to 0.5 percent by weight of the resin and reinforcement used. Utilization of mixtures of resins having different densities can also be employed to impart desired density to the finished product and to insure that the specific gravity is maintained below 1. Thus, for example, in constructing a polycarbonate resin racket, the use of different portions of two or more polycarbonates having different specific gravities can be utilized to provide a final resin product after foaming having the requisite specific gravity. Similarly, the shell portion of the frame can be made thicker or thinner by varying the mold temperature before injection.

The racket frames produced may be strung with conventional stringing material so that the rackets may be formed into conventional racket designs. They also lend themselves to stringing on conventional machines.

In employing the blowing agents, it is preferred to utilize chemical materials for this purpose. The use of gaseous blowing agents such as nitrogen, helium, carbon dioxide and the like is also possible.

In utilizing the term "carbon" in the specification and claims, it is intended to include in that term, carbon, graphite and graphitized carbon. Further, the racket frames of the instant invention are further characterized by the fact that finishes can be applied by electrodeposition techniques thereby rendering them capable of being decorated with a multiplicity of colors and metals for finish effects.

While the invention has been described with reference to certain specific examples and illustrative embodiments, this is for illustrative purposes only and is not intended to limit the invention except insofar as appears in the accompanying claims.

I claim:

1. A tennis racket frame comprising a unitary, injection molded tennis racket frame constructed of a fiber glass - carbon reinforced foamed resin having a specific gravity of less than 1, said resin frame having a head member, a handle section and an intermediate throat portion, a cellular core and a noncellular dense outer shell and containing at least 7 percent by weight glass fibers and at least 7 percent by weight carbon fibers, said fibers being oriented in a longitudinal plane in a random pattern relative to each other and following the contour of said frame with their long axes paralleling the longitudinal axis of said frame and wherein said fibers have an L/D ratio of at least 125 for the glass fibers and at least 225 for the carbon fibers

2. The frame of claim 1 wherein the glass fiber content is between 15 and 18 percent and the carbon fiber content is between 7 and 10 percent basis the weight of the resin.

3. The frame of claim 2 wherein the resin is selected from the group consisting of nylons and polycarbonates.

4. The frame of claim 2 wherein the shell portion of the frame is at least 3 percent of the total volume of the resin.

5. A tennis racket frame comprising an injection molded tennis racket frame constructed of a foamed nylon and having present therein between 7 and 20 percent glass fibers and between 7 to 20 percent carbon fibers basis the weight of the resin, said tennis racket frame having a head member, a handle section and an intermediate throat portion and having a specific gravity of 0.85 or less and possessing a dense noncellular outer shell and a cellular core, the carbon and glass fibers being oriented in a longitudinal plane in a random pattern relative to each other and following the contour of said frame with their long axes paralleling the longitudinal axis of said frame and the L/D ratio of the glass fibers in said frame being between 118 and 176 and for the carbon being between 225 and 352.

6. A tennis racket frame comprising an injection molded unitary tennis racket frame constructed of a foamed nylon having present therein between 7 to 20 percent glass fibers and between 7 to 20 percent carbon fibers basis the weight of the resin, said tennis racket frame having a head member, a handle section and an intermediate throat portion and having a specific gravity of 0.85 or less, said tennis racket frame having a dense noncellular outer shell and a cellular core, the carbon and glass fibers being oriented in a longitudinal plane in a random pattern relative to each other and following the contour of said frame with their long axes paralleling the longitudinal axis of said frame and the L/D ratio of the glass fibers being about 150 and the L/D ratio for the carbon fibers being about 303.

* * * * *